US011452431B2

(12) United States Patent
Woo

(10) Patent No.: US 11,452,431 B2
(45) Date of Patent: Sep. 27, 2022

(54) DISHWASHER

(71) Applicant: LG Electronics Inc., Seoul (KR)

(72) Inventor: Sangwoo Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 318 days.

(21) Appl. No.: 16/515,907

(22) Filed: Jul. 18, 2019

(65) Prior Publication Data

US 2020/0022558 A1 Jan. 23, 2020

(30) Foreign Application Priority Data

Jul. 18, 2018 (KR) ..... 10-2018-0083349

(51) Int. Cl.
*A47L 15/42* (2006.01)
*A47L 15/50* (2006.01)

(52) U.S. Cl.
CPC ..... *A47L 15/4234* (2013.01); *A47L 15/505* (2013.01); *A47L 15/507* (2013.01); *A47L 15/4278* (2013.01); *A47L 15/50* (2013.01); *A47L 2501/14* (2013.01)

(58) Field of Classification Search
CPC .. A47L 15/505; A47L 15/4234; A47L 15/507; A47L 15/50; A47L 2501/14; A47L 15/4278
See application file for complete search history.

(56) References Cited

U.S. PATENT DOCUMENTS 9,936,853 B2 * 4/2018 Choi ..... A47L 15/4217
2004/0187898 A1 * 9/2004 Chen ..... A47L 15/0002 134/58 D
2004/0261824 A1 * 12/2004 Eiermann ..... A47L 15/4221 134/57 D
2007/0079851 A1 * 4/2007 Park ..... A47L 15/4234 134/56 D
2008/0000506 A1 * 1/2008 Pyo ..... A47L 15/0002 134/106
2008/0236636 A1 * 10/2008 Pyo ..... A47L 15/4234 134/106
2008/0308136 A1 * 12/2008 Ahn ..... A47L 15/4234 134/56 D
2009/0056752 A1 * 3/2009 Han ..... A47L 15/0036 134/10
2009/0126766 A1 * 5/2009 Ahn ..... A47L 15/4234 134/56 D
2009/0235957 A1 * 9/2009 Kim ..... A47L 15/0007 134/25.2

(Continued)

*Primary Examiner* — Benjamin L Osterhout
(74) *Attorney, Agent, or Firm* — Fish & Richardson P.C.

(57) ABSTRACT

A dishwasher includes: a case; a tub; a door; a sump disposed below the tub and configured to store washing water; a spray nozzle configured to spray washing water into the tub; a heater configured to heat washing water and generate steam; a steam nozzle disposed at the door or the tub and configured to discharge steam to the tub; a first rack disposed in the tub and configured to receive a washing target to be washed by washing water sprayed from the spray nozzle; and a second rack disposed in the tub and configured to receive a washing target to be washed by steam supplied from the steam nozzle. The steam discharged from the steam nozzle is supplied to an inside of the second rack through one of a lower surface or a circumferential surface of the second rack.

20 Claims, 8 Drawing Sheets

(56) References Cited

U.S. PATENT DOCUMENTS

| | | | | |
|---|---|---|---|---|
| 2012/0055517 | A1* | 3/2012 | Yoo | A47L 15/0057 134/105 |
| 2012/0279527 | A1* | 11/2012 | Lee | A47L 15/0036 134/106 |
| 2014/0000663 | A1* | 1/2014 | McDaniel | A47L 15/508 134/200 |
| 2016/0051120 | A1* | 2/2016 | Lee | A47L 15/0039 134/18 |
| 2016/0051122 | A1* | 2/2016 | Lee | A47L 15/4285 134/57 D |
| 2017/0188777 | A1* | 7/2017 | Kim | A47L 15/0028 |

* cited by examiner

DISHWASHER

CROSS-REFERENCE TO RELATED APPLICATIONS

The present application claims priority under 35 U.S.C. 119 and 35 U.S.C. 365 to Korean Patent Application No. 10-2018-0083349, filed on Jul. 18, 2018, which is hereby incorporated by reference in its entirety.

FIELD

The present invention relates to a dishwasher, and more particularly, to a dishwasher in which an arrangement space for a washing target with steam is separately provided.

BACKGROUND

A dishwasher is a household appliance for cleaning dirt such as food wastes on dishes or cooking utensils (hereinafter, referred to as 'objects to be cleaned') by high-pressure washing water sprayed from a spray nozzle.

The dishwasher generally includes a tub forming a washing chamber and a sump mounted in the bottom of the tub to store the washing water. The washing water is moved to the spray nozzle by the pumping action of a washing pump mounted inside the sump, and the washing water moved to the spray nozzle is sprayed at a high pressure through a spray hole formed in the spray nozzle. Then, the washing water sprayed at a high pressure impinges against the surface of the washing target, so that the dirt on the washing target drops to the bottom of the tub.

Meanwhile, the dishwasher may perform cleaning or sterilization by using the heated washing water to wash the washing target or to supply steam to the washing target. However, even if steam is supplied to perform sterilization in the dishwasher, steam is not directly sprayed to the washing target, but is discharged uniformly to the washing chamber.

Therefore, even if the washing target which requires high-temperature cleaning or sterilization is placed in a rack, there is a problem that it is difficult to be directly influenced by the steam sprayed from the steam nozzle.

SUMMARY

The present invention has been made in view of the above problems, and provides a dishwasher for performing direct steam cleaning inside a washing target.

The present invention further provides a dishwasher in which a steam washing space is provided while utilizing the structure of a conventional dishwasher.

In accordance with an aspect of the present invention, a dishwasher includes: a case forming an outer shape; a tub that is provided inside the case and forms a washing chamber in which a washing target is accommodated; a door that is provided in a front surface of the tub and opens and closes the washing chamber; a sump that is disposed below the tub and stores washing water; at least one spray nozzle for spraying the washing water stored in the sump into a space inside the tub; a heater that heats a part of the washing water stored in the sump and generates steam; a steam nozzle that is disposed in a circumferential surface of the door or the tub and supplies the steam generated by the heater to the washing chamber; a first rack that is disposed in the washing chamber, and in which the washing target washed by the washing water sprayed from the spray nozzle is placed; and a second rack that is disposed in the washing chamber, and in which the washing target washed by the steam supplied from the steam nozzle is placed, wherein the second rack is disposed in a position where the steam discharged from the steam nozzle is supplied to the inside of the second rack through one side surface among a lower surface or a circumferential surface of the second rack.

The steam nozzle is disposed inclined upward from a lower end portion of the door or a circumferential surface the tub.

The steam nozzle is disposed in a lower end portion of the door, and the second rack is disposed in a direction in which the steam nozzle faces, when the door is closed.

The second rack includes: an outer wall frame that forms a circumferential surface and a lower surface of the second rack and is formed in a lattice shape; and a support frame for supporting the washing target placed in a space formed by the outer wall frame.

The support frame protrudes upward from a lower surface of the second rack.

The support frame is disposed in an inner front side of the second rack.

The dishwasher further includes a fixing portion that protrudes outward from one side of the outer wall frame and fixes the second rack to the door or the first rack.

A plurality of steam nozzles are formed in the lower side of the door at the same height, and a plurality of support frames respectively corresponding to the plurality of steam nozzles are provided in the second rack, wherein the plurality of steam nozzles are arranged to discharge steam to each of the corresponding plurality of support frames.

The first rack further includes an upper rack disposed in an upper portion of the washing chamber, and a lower rack disposed below the upper rack inside the washing chamber, wherein the second rack is detachably disposed in an inner front side of the lower rack.

The first rack further includes an upper rack disposed in an upper portion of the washing chamber, and a lower rack disposed below the upper rack inside the washing chamber, wherein the second rack is disposed between the door and the lower rack and is detachably disposed in one side of the door or the lower rack.

The dishwasher further includes: a washing pump provided with an impeller for pumping the washing water stored in the sump, a washing motor for rotating the impeller, and the heater for heating the washing water existing inside; a spray nozzle connecting pipe connecting the washing pump and the at least one spray nozzle; a steam supply pipe forming a steam flow path connecting the washing pump and the steam nozzle; and a steam supply valve that is disposed in the steam flow path, closes the steam flow path when the washing pump supplies the flowing washing water to the plurality of spray nozzles, and opens the steam flow path when the washing pump supplies the generated steam or high-temperature washing water to the steam nozzle.

BRIEF DESCRIPTION OF THE DRAWINGS

The above and other objects, features and advantages of the present invention will be more apparent from the following detailed description in conjunction with the accompanying drawings, in which.

DETAILED DESCRIPTION

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

The front (F), rear (R), left (Le), right (Ri), up (U), and down (D) views of the drawings are jut used for convenience of description of the invention and do not limit the scope of rights. Therefore, the direction can be set differently from the above display depending on a reference.

Hereinafter, the present invention will be described with reference to the drawings for explaining a dishwasher and a control method thereof according to embodiments of the present invention.

Figure 1:
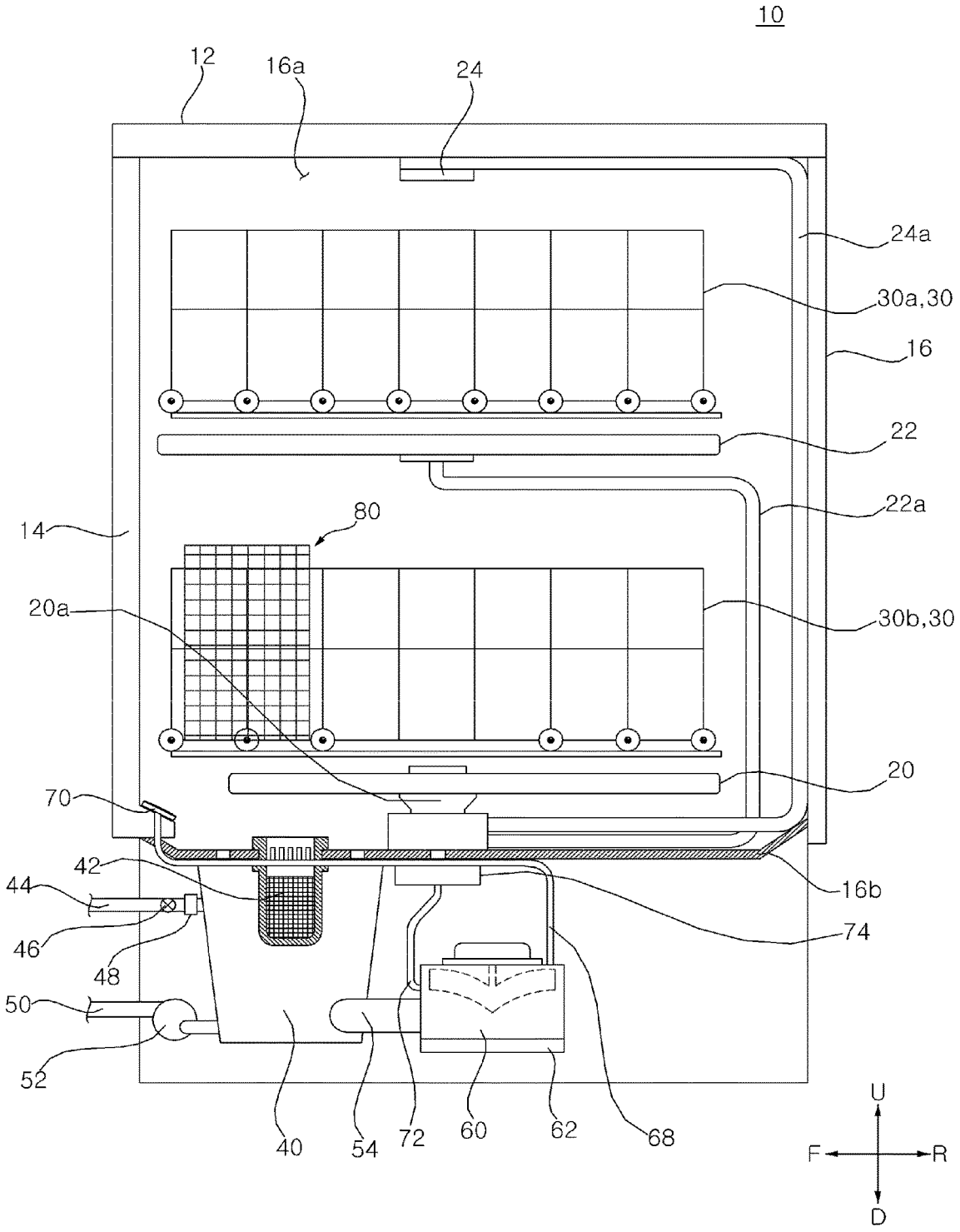
FIG. 1 is a schematic cross-sectional view of a dishwasher according to an embodiment of the present invention.

FIG. 1 is a schematic structure view of a dishwasher according to an embodiment of the present invention.

Overall Configuration

A dishwasher 10 according to the present embodiment includes a case 12 forming an outer shape of the dishwasher 10, a tub 16 forming a washing chamber 16*a* that is provided in the case 12 and accommodates a washing target, a door 14 that is provided in the front surface of the tub 16 and opens and closes the washing chamber 16*a*, and a sump 40 that is disposed on the lower side D of the tub 16 and stores washing water.

The sump 40 according to the present embodiment may be provided with a filter 42 for filtering the washing water supplied from the outside or the washing water introduced from the tub 16.

The dishwasher 10 according to the present embodiment includes a plurality of spray nozzles 20, 22, and 24 for spraying washing water into the washing chamber 16*a* inside the tub 16, a washing pump 60 for supplying the washing water stored in the sump 40 to the plurality of spray nozzles 20, 22, and 24, a heater 62 for heating the washing water existing in the washing pump 60 to generate steam or high-temperature washing water, a steam nozzle 70 for spraying high-temperature washing water or steam heated by the heater 62 into the washing chamber, a switching valve 74 for connecting the washing water supplied from the washing pump 60 to at least one of the plurality of spray nozzles, and a rack 30, 80 for holding a washing target in the tub 16.

The rack 30, 80 according to the present embodiment includes a first rack 30 for holding the washing target so as to wash the washing target by the washing water sprayed by the plurality of the spray nozzles 20, 22, and 24, and a second rack 80 for holding the washing target which is washed by steam or high-temperature washing water sprayed by the steam nozzle 70. The first rack 30 may include an upper rack 30*a* disposed in the upper side U based on an arranged position inside the washing chamber 16*a* and a lower rack 30*b* disposed in the lower side D.

The plurality of spray nozzles 20, 22, and 24 may be disposed in the vertical direction inside the washing chamber 16*a*. The plurality of spray nozzles 20, 22, and 24 according to the present embodiment includes a lower spray nozzle 20 for spraying washing water from the lower side of the lower rack 30*b* toward the lower rack 30*b*, an upper spray nozzle 22 that is disposed between the upper rack 30*a* and the lower rack 30*b* and sprays washing water toward the upper rack 30*a* or the lower rack 30*b* and the upper rack 30*a*, and a top spray nozzle 24 disposed in an upper end of the washing chamber 16*a* which is the upper side of the upper rack 30*a* and spraying washing water into a space of the washing chamber 16*a*. The plurality of spray nozzles 20, 22, and 24 may receive the washing water from the washing pump 60 through a plurality of spray nozzle connecting pipes 20*a*, 22*a*, and 24*a*.

The switching valve 74 may selectively supply the washing water pumped by the washing pump 60 to at least one of the lower spray nozzle 20, the upper spray nozzle 22, and the top spray nozzle 24. The switching valve 74 may selectively connect a washing water supply pipe 72 through which the washing water discharged from the washing pump 60 flows to at least one of the plurality of spray nozzle connecting pipes 20*a*, 22*a*, and 24*a*.

The washing pump 60 may pump the washing water stored in the sump 40 to supply to the plurality of spray nozzles 20, as an impeller 64 operated by a washing motor 66 rotates. The washing pump 60 may supply the steam or high-temperature washing water generated by heating the washing water through the heater 62 disposed therein to the steam nozzle 70.

The washing pump 60 may be connected to the sump 40 through a water collecting pipe 54 in which a water collecting flow path is formed. A check valve (not shown) for opening and closing a connection between the sump 40 and the washing pump 60 may be disposed in the inlet of the water collecting pipe 54 or the washing pump 60.

The check valve according to the present embodiment may be opened when the washing pump 60 is operated to flow the washing water, and may be closed when the washing pump 60 stops and the washing water does not flow. The check valve may be opened by the flow pressure of the washing water of the washing pump 60. However, the above-mentioned check valve is just an example, and the check valve can be constituted by a solenoid valve which is opened or closed by an electronic signal.

The dishwasher 10 according to the present embodiment may include a water supply assembly for supplying washing water into the dishwasher and a drain assembly for draining water stored inside the dishwasher. The water supply assembly according to the present embodiment includes a water supply pipe 44 forming a flow path for supplying washing water from an external water source, a water supply valve 46 for opening and closing a water supply flow path formed in the water supply pipe 44, and a flow meter 48 for measuring the flow rate of the washing water flowing to the sump 40 through the water supply flow path.

The drain assembly according to the present embodiment may include a drain pipe 50 in which a drain flow path for guiding the water stored in the sump 40 to the outside is formed, and a drain pump 52 which is disposed in the drain flow path formed in the drain pipe 50, and drains the washing water in the sump 40 to the outside. The drain pump may include a drain motor (not shown) for generating a rotational force.

Figure 2:
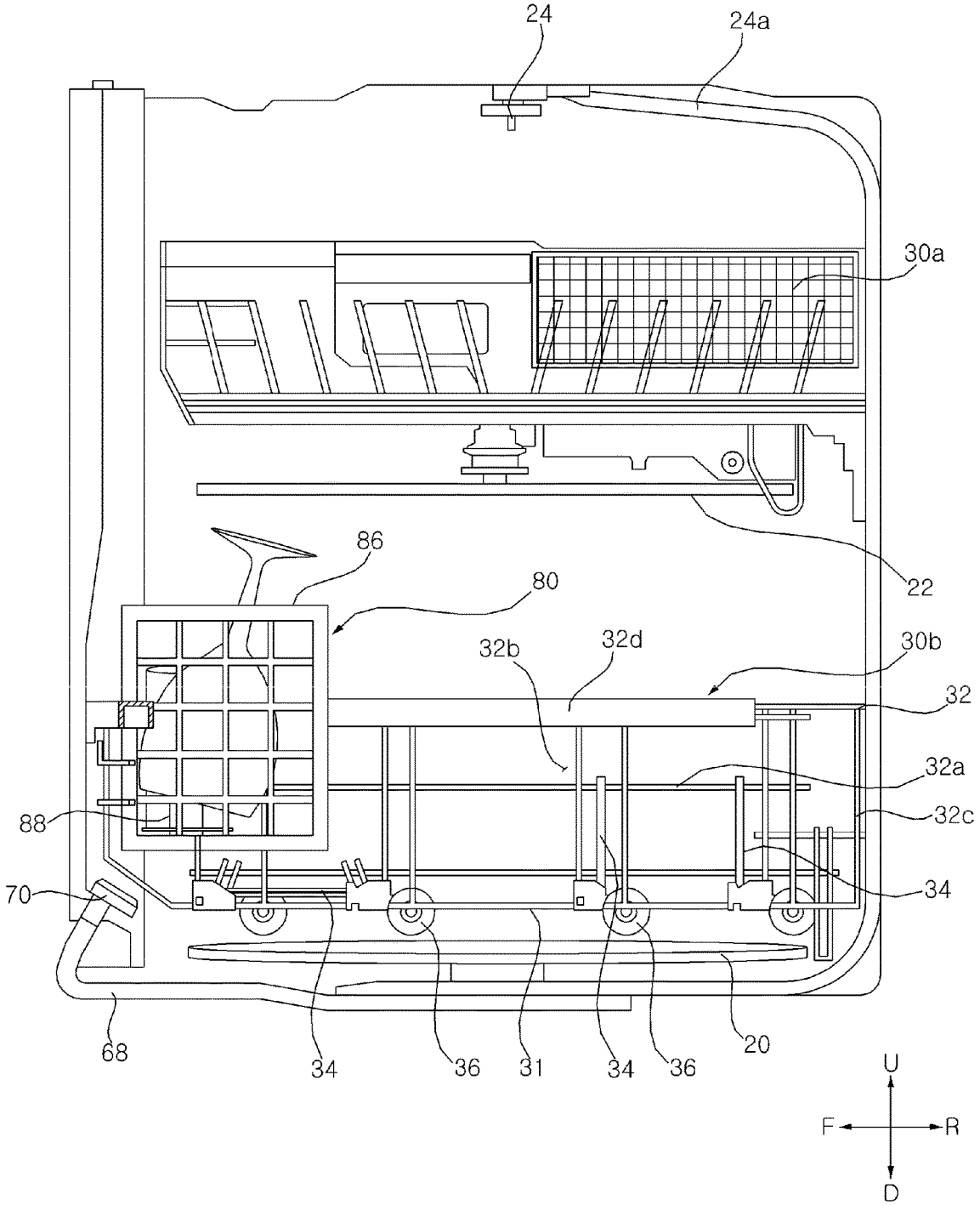
FIG. 2 is a schematic cross-sectional view for explaining the arrangement of a second rack of a dishwasher according to an embodiment of the present invention.
Figure 3:
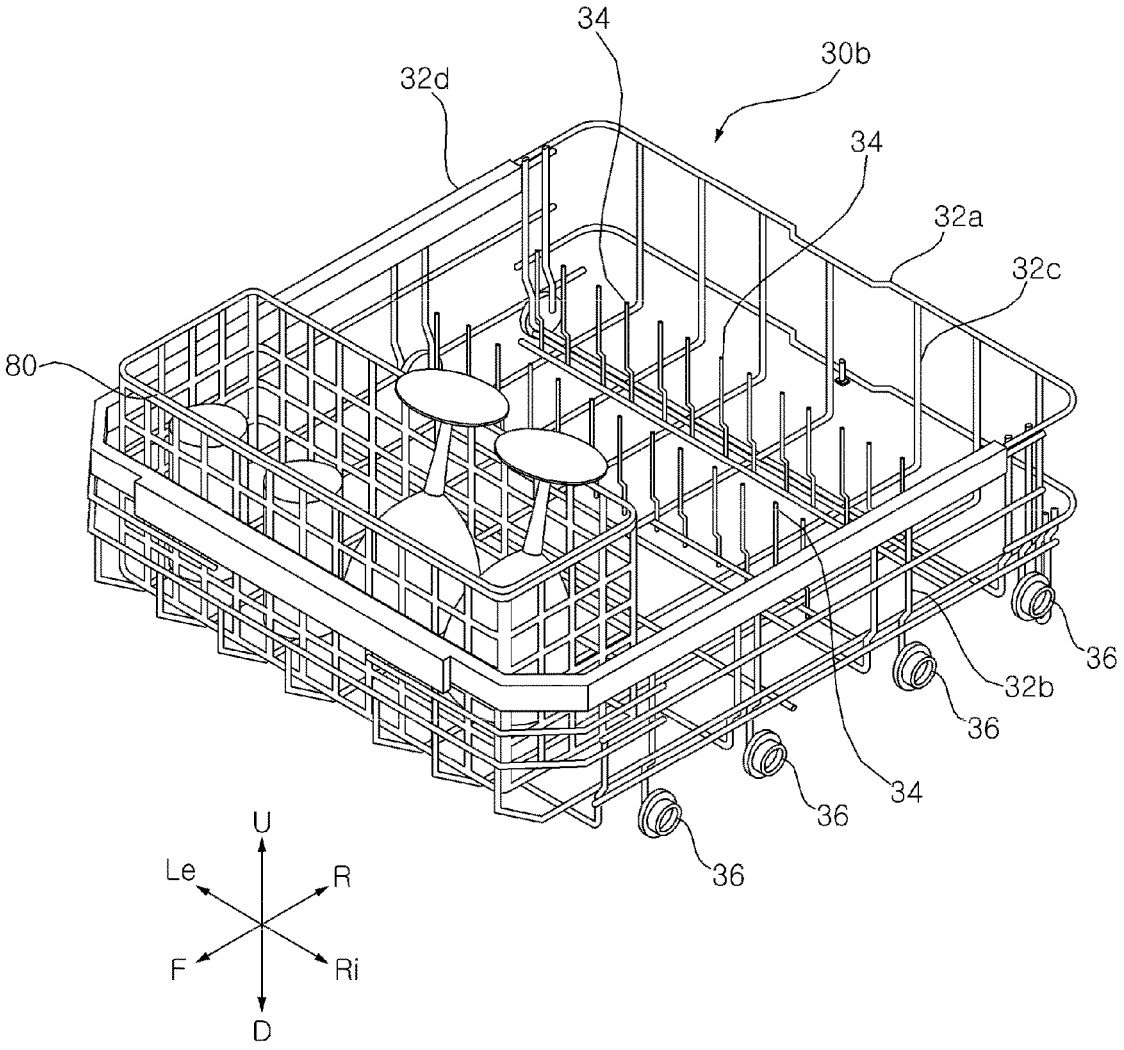
FIG. 3 is a perspective view illustrating a second rack and a lower rack according to an embodiment of the present invention.
Figure 4:
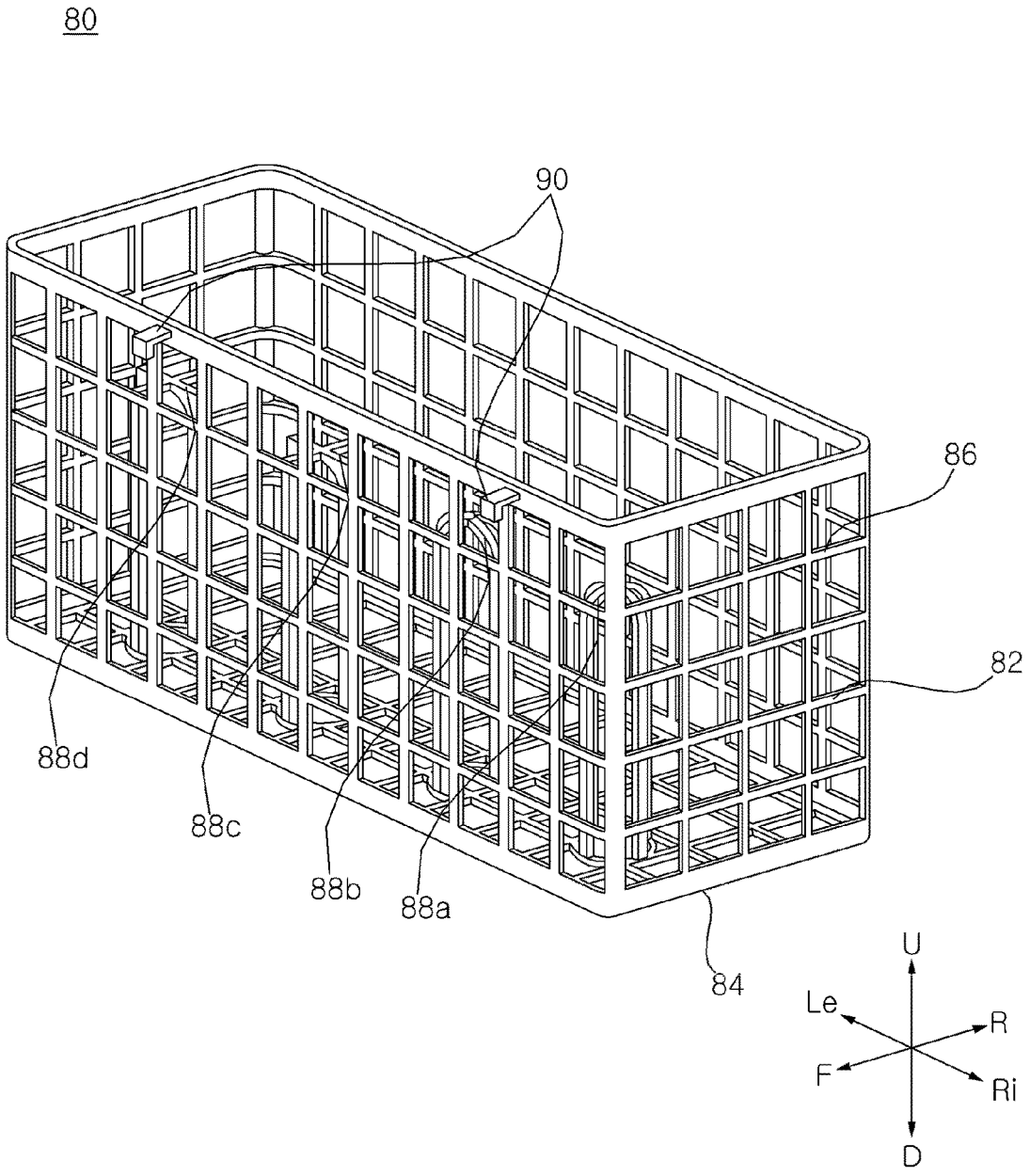
FIG. 4 is a perspective view of a second rack according to an embodiment of the present invention.
Figure 5A:
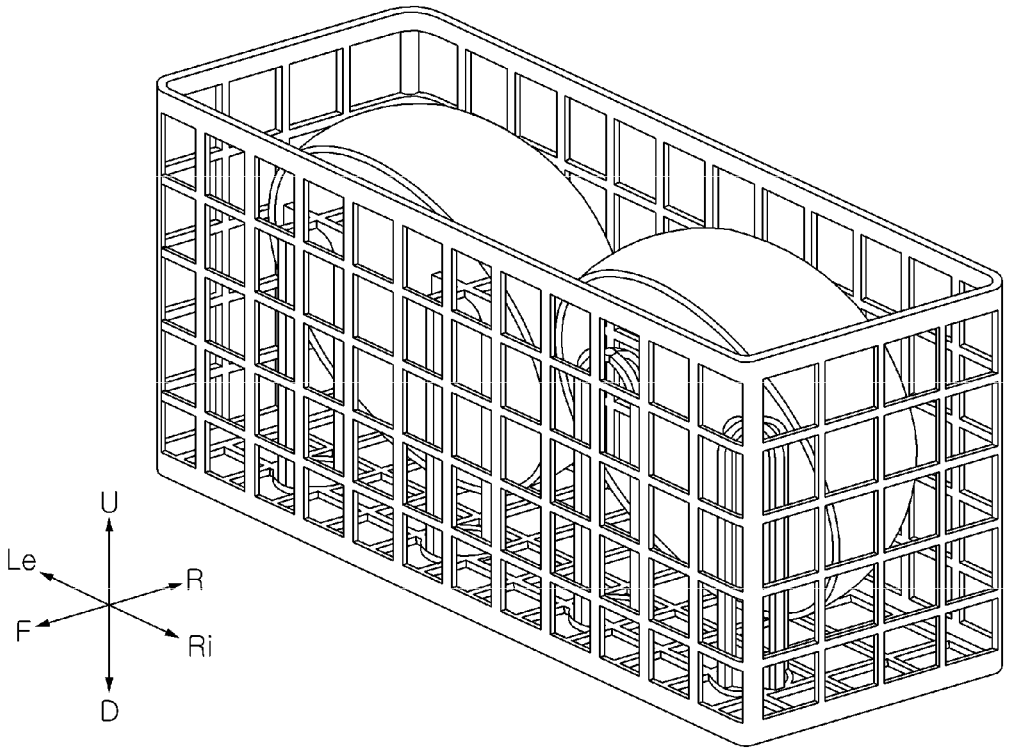
FIGS. 5A and 5B are perspective views illustrating an example in which a washing target is placed on a second rack according to an embodiment of the present invention.
Figure 5B:
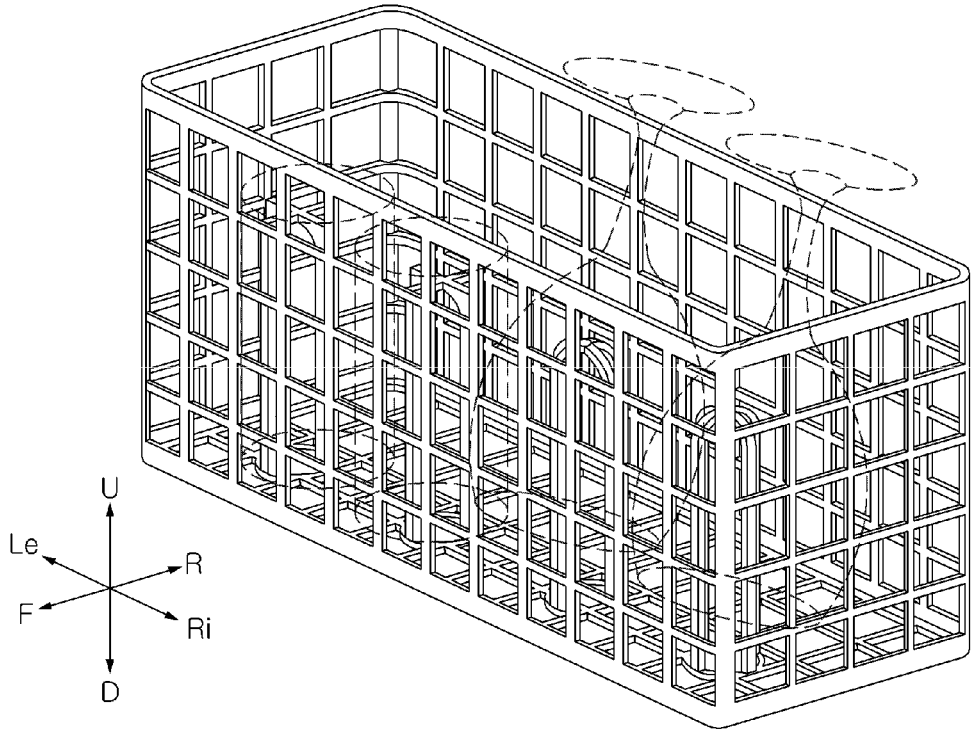
Figure 6:
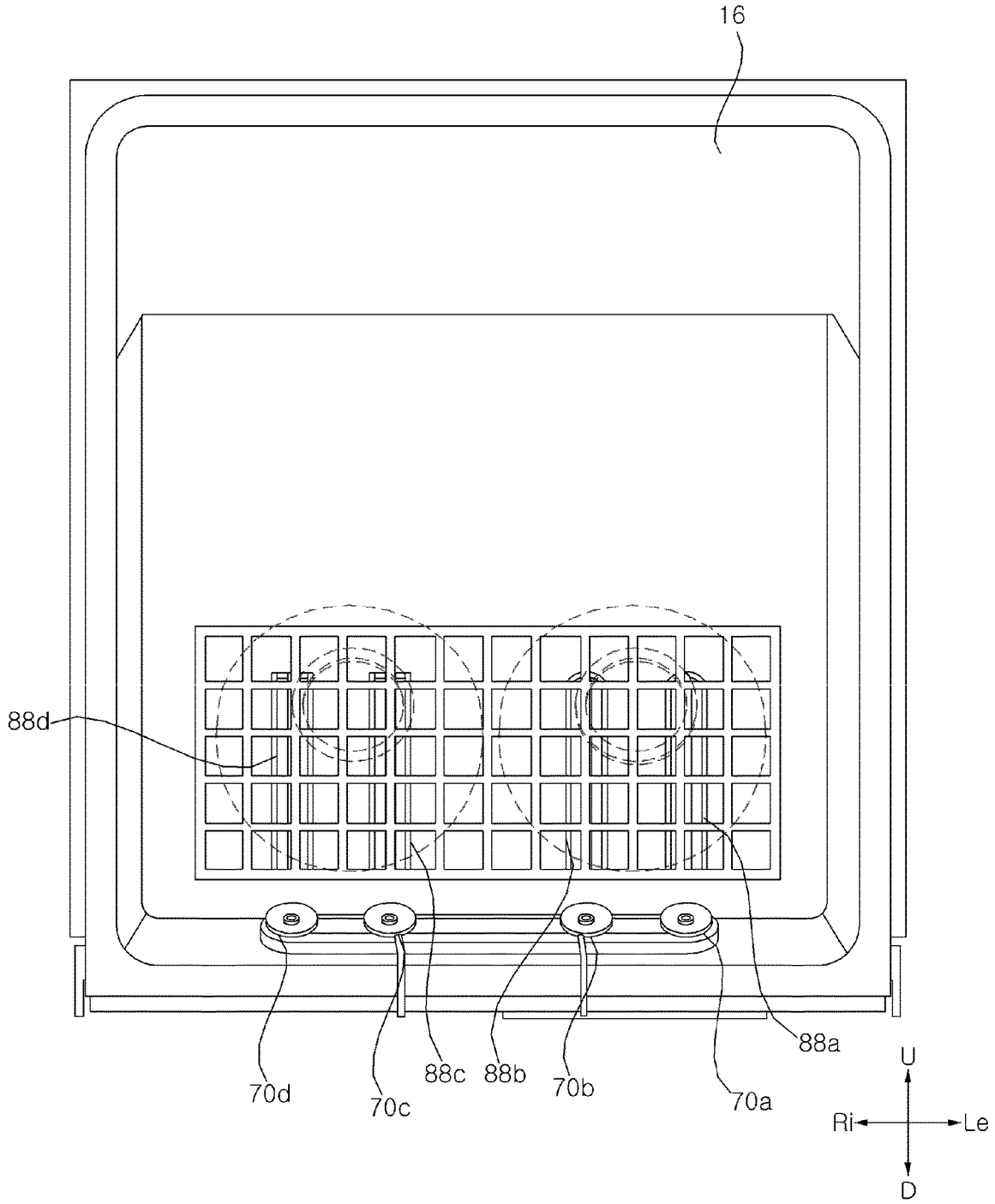
FIG. 6 is a view for explaining the arrangement of a second rack and a door according to an embodiment of the present invention.

FIG. 2 is a schematic cross-sectional view for explaining the arrangement of a second rack of a dishwasher according to an embodiment of the present invention. FIG. 3 is a perspective view illustrating a second rack and a lower rack according to an embodiment of the present invention. FIG. 4 is a perspective view of a second rack according to an embodiment of the present invention. FIGS. 5A and 5B are perspective views illustrating an example in which a washing target is placed on a second rack according to an embodiment of the present invention. FIG. 6 is a view for explaining the arrangement of a second rack and a door according to an embodiment of the present invention.

Hereinafter, the configuration and arrangement of the steam nozzle, the first rack, and the second rack according to the embodiment of the present invention will be described with reference to FIGS. 2 to 6.

Steam Nozzle/Steam Supply Pipe

The steam nozzle 70 according to the present embodiment sprays steam or high temperature washing water generated by the heater 62 disposed inside the washing pump 60 into the washing chamber 16*a*. The steam nozzle 70 may be connected to the washing pump 60 through the steam supply pipe 72.

When the high temperature washing water or the steam is sprayed to the steam nozzle 70, the washing motor 66 installed in the washing pump 60 may be operated or stopped.

When the steam is sprayed intensively to a steam-cleaning target placed in the second rack 80, the washing motor 66 is operated to spray the high-pressure steam or the high-temperature washing water by the steam nozzle 70. In addition, when the steam is supplied to the inside of the washing chamber 16*a* so as to dry the tableware in the washing chamber that has used steam, the washing motor 66 is stopped and only the heater 62 is operated so that the low-pressure steam can be sprayed into the washing chamber 16*a*.

The steam nozzle 70 is disposed in such a manner that sprayed steam is directed to the washing chamber 16*a*. The steam nozzle 70 is disposed to be inclined from the lower end of the door 14 or the circumferential surface of the tub 16 to the upper side U so that the steam generated by the heater 62 can be supplied to the washing chamber 16*a*.

Referring to FIG. 2, the steam nozzle 70 according to the present embodiment is disposed in the lower portion of the door 14. A plurality of steam nozzles 70 according to the present embodiment may be disposed in the same height in the left and right directions in the lower portion of the door 14. The steam nozzle 70 according to the present embodiment may be disposed to face the second rack 80 in a state where the door is closed.

The steam nozzle 70 according to the present embodiment is disposed to be inclined upward with respect to the bottom surface 16*b* of the tub 16 so as to spray steam into the inner space of the washing chamber 16*a*. The steam nozzle 70 according to the present embodiment may be disposed to be inclined from the lower portion of the washing chamber 16*a* toward the upper portion of the washing chamber.

The steam nozzle 70 according to the present embodiment may be disposed to spray steam or high-temperature washing water toward the second rack 80. The steam nozzle 70 according to the present embodiment may be disposed to spray steam or the like toward a lower surface 84 of the second rack 80. The steam nozzle 70 according to the present embodiment may be disposed to spray steam or the like toward a support frame 88 disposed in the second rack 80.

Referring to FIG. 6, the dishwasher 10 according to the present embodiment may include a plurality of steam nozzles 70*a*, 70*b*, 70*c*, and 70*d* disposed in the lower end of the door 14. The plurality of steam nozzles 70*a*, 70*b*, 70*c*, and 70*d* may be disposed in the same height in the lower end of the door 14. The steam nozzle 70 according to the present embodiment may be provided with the same number of support frames 88*a*, 88*b*, 88*c*, 88*d* provided in the second rack 80 described below. The plurality of steam nozzles 70*a*, 70*b*, 70*c*, and 70*d* are disposed in positions corresponding to the plurality of support frames 88*a*, 88*b*, 88*c*, and 88*d*.

A steam supply valve (not shown) for opening/closing the washing pump 60 and the steam nozzle 70 may be disposed in the steam supply pipe 72 according to the present embodiment. The steam supply valve may use a switch valve that is closed when supplying washing water to at least one of the plurality of spray nozzles, and is opened when supplying steam or high-temperature washing water to the steam nozzle 70.

First Rack and Second Rack

The first rack 30 in which the washing target washed by the washing water sprayed from the plurality of spray nozzles 20, 22, 24 according to the present embodiment is placed, and the second rack 80 in which the washing target washed by steam or high temperature washing water sprayed from the steam nozzle is placed are included.

The first rack 30 according to the present embodiment may include the upper rack 30*a* disposed in an upper portion of the washing chamber 16*a* and the lower rack 30*b* disposed in a lower side D of the upper rack 30*a*. The upper rack 30*a* and the lower rack 30*b* may be disposed vertically inside the washing chamber 16*a*.

The upper rack 30*a* is disposed between the top spray nozzle 24 and the upper spray nozzle 22. The lower rack 30*b* is disposed between the upper spray nozzle 22 and the lower spray nozzle 20.

The lower rack 30*b* may include a frame 32 forming a space in which the washing target is accommodated, a plurality of fixing guides 34 that is rotatably provided inside the frame 32 and supports the tableware in a fixed state, and a moving roller 36 that is provided in both outer ends of the frame 32 and movably supports the frame 32. The configuration of the lower rack 30*b* described below may be similarly formed in the upper rack 30*a*. That is, the upper rack 30*a*, like the lower rack 30*b*, may also include the frame, the fixing guide, and the moving roller described above.

The frame 32 may be formed in a grill shape, and the frame 32 may be provided in such a manner that metal lines are intersected in a lattice pattern. That is, since the frame 32 is formed in a grill shape, the washing water sprayed from the lower spray nozzle 20 or the upper spray nozzle 22 may be effectively transmitted to the washing target housed in the lower rack 30*b*.

The frame 32 may include an outer frame 32*a*, a horizontal frame 32*b*, a vertical frame 32*c*, and a cover frame 32*d*. The outer frame 32*a* may be formed in a continuous horizontal loop shape as one or more frames are connected.

The vertical frame 32*c* may be arranged in the drawing direction of the lower rack 30*b* and connected to the outer frame 32*a*. In addition, the horizontal frame 32*b* is disposed to intersect with the vertical frame 32*c* in the vertical direction and may be connected to the outer frame 32*a* and the vertical frame 32*c*. The cover frame 32*d* may cover the front and left and right sides of the outer frame 32 disposed in the uppermost side. The cover frame 32*d* is disposed in the outermost side in the front and left and right sides of the lower rack 30*b*. The cover frame 32*d* may minimize friction between the lower rack 30*b* and the door 14 or the tub 16.

The configuration of the lower rack 30*b* is just an example, and any one or more of the outer frame 32*a*, the horizontal frame 32*b*, and the vertical frame 32*c* may be omitted or a part thereof may be omitted. In addition, it can be variously modified as long as it can perform the function of holding and washing the washing target inside the washing chamber 16*a*.

The moving roller 36 may be positioned in the left and right sides of the frame 32 with respect to the drawing direction of the frame 32. The moving roller 36 according to the present embodiment may be provided in the neb and the rear end of the frame located outermost among the outer frame 32*a* or the vertical frame 32*c*.

One end of the fixing guide 34 is rotatably connected to a certain portion of the horizontal frame 32*b* or the vertical frame 32*c* formed on a bottom surface 31 of the lower rack 30*b*. The fixing guide 34 may be disposed perpendicularly to the bottom surface on which the horizontal frame 32*b* and the vertical frame 32*c* of the lower rack 30*b* are disposed, or disposed parallel to the bottom surface.

The fixing guide 34 may support a tableware placed inside the lower rack 30*b*, when being disposed perpendicularly to the bottom surface 31 of the lower rack 30*b*. In addition, the fixing guide 34 may be horizontally disposed on the bottom surface 31 of the lower rack 30*b* to provide a space in which the second rack 80 is disposed inside the lower rack 30*b*.

Referring to FIG. 2, when the second rack 80 is fixed to the lower rack 30*b*, the fixing guide 34 positioned in the front side F of the lower rack 30*b* is disposed horizontally in the bottom surface 31 of the lower rack 30*b*. In addition, the fixing guide 34 positioned in the rear side R of the lower rack 30*b* may be disposed perpendicular to the bottom surface 31 of the lower rack 30*b* so as to support the tableware placed therein.

The second rack 80 is provided with a space for holding the tableware to be steam-cleaned using the steam sprayed from the steam nozzle 70. The second rack 80 according to the present embodiment has a box shape in which the upper side U is opened. The second rack 80 has an upper surface that is opened, and an outer wall frame 86 having a lattice shape is formed in a circumferential surface 82 and a lower surface 84. Thus, washing water or steam can flow into the second rack 80 through the outer wall frame 86 having a lattice shape formed in the circumferential surface 82 and the lower surface 84.

The second rack 80 according to the present embodiment is disposed in a direction in which the steam nozzle 70 sprays steam. Referring to FIG. 2, the steam nozzle 70 according to the present embodiment is disposed in the lower end of the door 14, and the second rack 80 is disposed in the upper side U of the rear side R of the steam nozzle 70. The second rack 80 is disposed between the upper spray nozzle 22 and the lower spray nozzle of the washing chamber 16*a*, and disposed in the front side adjacent to the door 14. The second rack 80 according to the present embodiment is accommodated inside the front side of the lower rack 30*b*. That is, the second rack 80 according to the present embodiment abuts on at least a part of the frame disposed in the front surface of the lower rack 30*b*, and may be placed inside the lower rack 30*b*. The second rack 80 according to the present embodiment is detachably disposed in the lower rack 30*b*.

The second rack 80 includes the outer wall frame 86 forming the circumferential surface 82 and the lower surface 84, and the support frame 88 supporting a tableware placed in a space formed by the outer wall frame 86. In addition, the second rack 80 further includes a fixing portion 90 that protrudes outward from one side of the outer wall frame 86 and fixes the second rack 80 to the door 14 or the lower rack 30*b*.

The fixing portion 90 according to the embodiment of the present invention may have a hook shape protruding forward. Therefore, the fixing portion 90 can be fastened in such a manner that it engages with the frame disposed in the front surface of the door 14 or the lower rack 30*b*.

The outer wall frame 86 is formed in the circumferential surface 82 and the lower surface 84 excluding the upper surface. The outer wall frame 86 forms a space for accommodating the washing target inside the second rack 80, and is configured to facilitate the flow of washing water through the lower surface 84 and the circumferential surface 82.

The support frame 88 disposes the washing target, which is placed inside the space formed by the outer wall frame 86, to be inclined toward the steam nozzle 70. The support frame 88 is formed to protrude to the upper side U from the outer wall frame 86 forming the lower surface 84 of the second rack 80. The support frame 88 may be formed in a columnar shape protruding from the lower surface 84 of the second rack 80 to the upper side U.

The support frame 88 may be disposed in the inner front side F of the second rack 80. Accordingly, the inner portion of the bowl formed by the washing target, which is placed in the second rack 80, may be disposed to be inclined toward the portion where the steam of the steam nozzle 70 is sprayed.

A plurality of support frames 88 according to the present embodiment may be mounted inside the second rack 80. The plurality of support frames 88*a*, 88*b*, 88*c*, 88*d* may have the same distance that is spaced rearward R from the door 14. The plurality of support frames 88*a*, 88*b*, 88*c*, and 88*d* are disposed in the same position in the front-rear direction F-R, and disposed spaced apart at a certain distance in the left-right direction Ri-Le. The plurality of support frames 88*a*, 88*b*, 88*c*, and 88*d* may be disposed in positions corresponding to the plurality of steam nozzles 70*a*, 70*b*, 70*c*, and 70*d*.

The support frame according to the present embodiment includes a first support frame 88*a*, 88*b* having a shape of bent upper end and a second support frame 88*c*, 88*d* having a shape of bent upper end. In the second rack 80 according to the present embodiment, two first support frames 88*a* and 88*b* and two second support frames 88*c* and 88*d* are provided.

Second Embodiment

Figure 7:
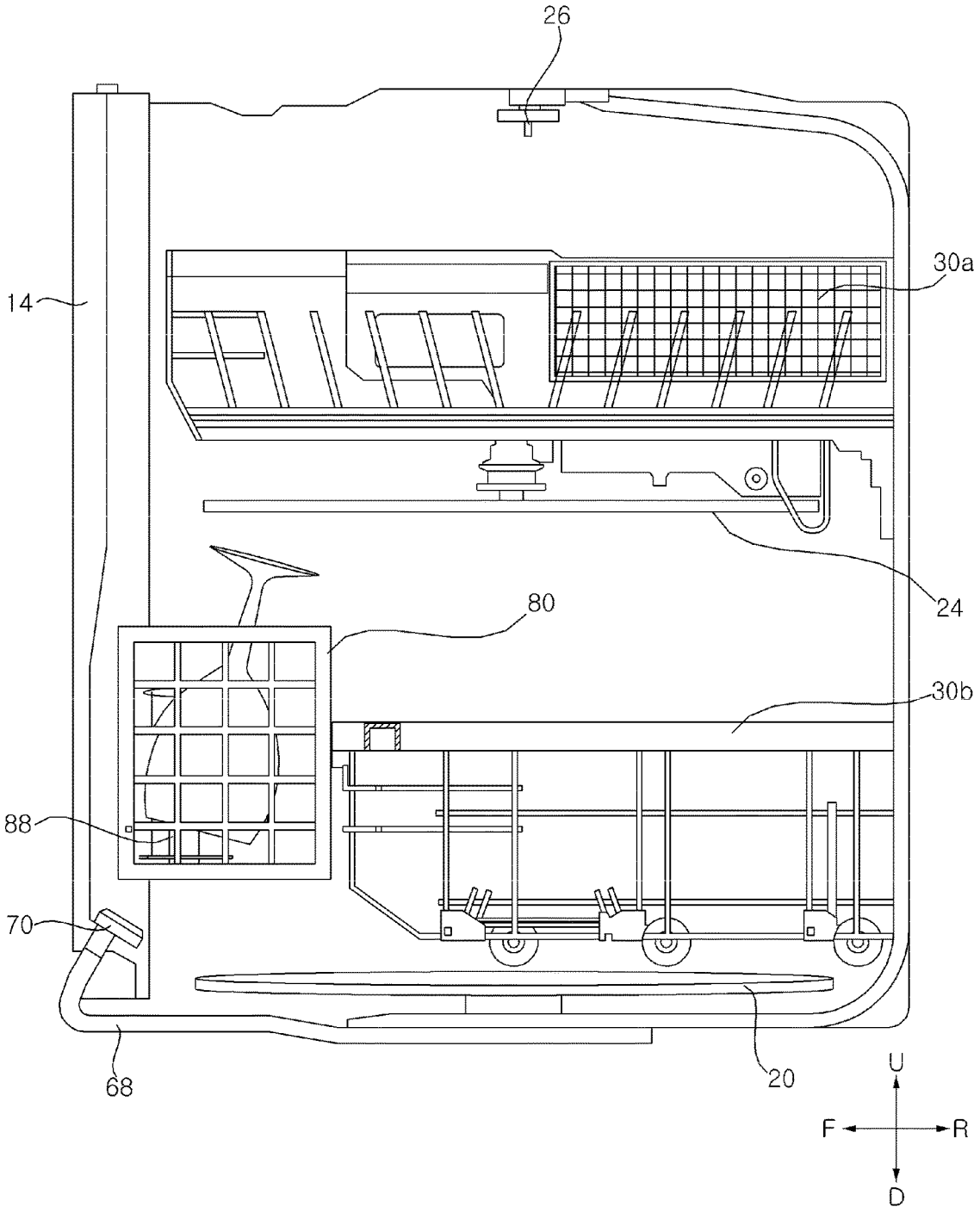
FIG. 7 is a schematic cross-sectional view for explaining the arrangement of a second rack of a dishwasher according to another embodiment of the present invention.

FIG. 7 is a schematic cross-sectional view for explaining the arrangement of a second rack of a dishwasher according to another embodiment of the present invention. Hereinafter, the arrangement of the second rack according to another embodiment of the present invention will be described with reference to FIG. 7.

The second rack 80 according to another embodiment of the present invention may be disposed between the lower rack 30*b* and the door 14. In this case, the second rack 80 may have a structure that can be attached to or detached from any one of the lower rack 30*b* and the door 14. That is, the fixing portion 90 provided in the second rack 80 may be fastened to one side of the door 14 or the lower rack 30*b*.

The second rack 80 according to the present embodiment is configured to include the outer frame 86, the support frame 88, and the fixing portion 90. The second rack 80 according to the present embodiment is disposed in the lower front F of the washing chamber 16*a*. That is, similarly to the first embodiment, it is disposed in a position where the steam sprayed from the steam nozzle 70 can be supplied to the inside of the second rack 80 through the lower surface 84 of the second rack 80. The second rack 80 may be fixedly disposed between the lower rack 30*b* and the door 14.

According to the dishwasher of the present invention, one or more of the following effects can be obtained.

First, steam can be sprayed to the inside of the washing target, and the inside of the washing target can be cleaned with steam, thereby achieving disinfection with high temperature steam.

Second, the structure of the conventional dishwasher can be utilized as the second rack in which the washing target to be washed with steam is placed can be detachably disposed in the existing lower rack.

Third, a plurality of steam nozzles and a plurality of support frames are provided, and a plurality of steam nozzles and a plurality of support frames are arranged correspondingly, so that the plurality of washing targets can be steam-cleaned respectively.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A dishwasher comprising:

a tub that defines a washing chamber configured to receive one or more washing targets and that is opened frontward of the washing chamber;

a door disposed at the opened frontward of the tub and configured to open and close at least a portion of the washing chamber;

a sump disposed vertically below the tub and configured to store washing water;

at least one spray nozzle configured to spray washing water stored in the sump into the washing chamber;

a heater configured to heat at least a part of washing water stored in the sump to thereby generate steam;

at least one steam nozzle disposed at a circumferential surface of the door or a circumferential surface of the tub and configured to supply steam generated by the heater to the washing chamber;

a first rack assembly disposed in the washing chamber and configured to receive a first washing target to be washed by washing water sprayed from the at least one spray nozzle, the first rack assembly comprising an upper rack disposed in an upper portion of the washing chamber and a lower rack disposed vertically below the upper rack in the washing chamber; and a second rack configured to receive a second washing target to be washed by steam supplied from the steam nozzle and configured to be detachably disposed inside of the lower rack at a front side of the lower rack facing the door, wherein the second rack is disposed at a position in the washing chamber to receive steam discharged from the steam nozzle to an inside of the second rack through at least one of a lower surface of the second rack or a circumferential surface of the second rack, wherein the second rack is disposed above the at least one steam nozzle, the second rack comprising:

an outer wall frame that defines the circumferential surface of the second rack and the lower surface of the second rack, the outer wall frame having a lattice shape including a plurality of openings, and a support frame disposed in a space defined by the outer wall frame and configured to support the second washing target placed in the space defined by the outer wall frame, and wherein the at least one steam nozzle is configured to spray steam toward the lower surface of the second rack and the support frame.

2. The dishwasher of claim 1, wherein the at least one steam nozzle has a nozzle surface that is inclined upward toward the second rack with respect to a bottom surface of the tub.

3. The dishwasher of claim 1, wherein the at least one steam nozzle is configured to face the second rack based on the door being closed.

4. The dishwasher of claim 1, wherein the support frame protrudes upward from the lower surface of the second rack.

5. The dishwasher of claim 1, wherein the second rack further comprises a fixing portion that protrudes outward from a side of the outer wall frame and that is configured to fix the second rack to the door or the lower rack.

6. The dishwasher of claim 3, wherein the at least one steam nozzle comprises a plurality of steam nozzles that are each arranged at an equal height from a bottom surface of the tub, wherein the support frame is one of a plurality of support frames that are disposed in the second rack and that correspond to the plurality of steam nozzles, respectively, and wherein each of the plurality of steam nozzles is configured to discharge steam to one of the plurality of support frames.

7. The dishwasher of claim 6, wherein the plurality of steam nozzles are spaced apart from the lower surface of the second rack.

8. The dishwasher of claim 1, further comprising:

a washing pump configured to supply washing water or steam to the tub, the washing pump comprising an impeller configured to pump washing water stored in the sump, a washing motor configured to rotate the impeller, and the heater configured to heat washing water in the washing pump;

a spray nozzle connecting pipe that connects the washing pump to the at least one spray nozzle;

a steam supply pipe that defines a steam flow path that connects the washing pump to the at least one steam nozzle; and a steam supply valve disposed in the steam flow path, the steam supply valve being configured to:

close the steam flow path based on the washing pump supplying washing water to the at least one spray nozzle, and open the steam flow path based on the washing pump supplying steam or washing water to the at least one steam nozzle.

9. The dishwasher of claim 1, wherein the plurality of openings are configured to communicate steam discharged from the at least one steam nozzle with the inside of the second rack.

10. The dishwasher of claim 1, wherein the support frame is configured to insert into an inner space of the second washing target to thereby support the second washing target.

11. The dishwasher of claim 1, wherein the second rack is configured to be detachably coupled to a rear surface of the door and disposed forward of the lower rack.

12. The dishwasher of claim 1, wherein at least a portion of the second rack protrudes upward of an upper surface of the lower rack.

13. The dishwasher of claim 1, wherein the first rack assembly further comprises a plurality of fixing guides that protrude from a bottom surface of the lower rack and that are configured to hold the first washing target therebetween, and wherein the second rack is disposed forward of the plurality of fixing guides.

14. The dishwasher of claim 1, wherein the at least one spray nozzle is disposed vertically below the lower rack and configured to spray washing water to the first washing target in the first rack assembly and the second washing target in the second rack.

15. The dishwasher of claim 1, wherein the at least one steam nozzle is disposed vertically above the at least one spray nozzle.

16. The dishwasher of claim 15, wherein at least a portion of the at least one steam nozzle is disposed vertically between a bottom surface of the lower rack and the lower surface of the second rack.

17. The dishwasher of claim 1, wherein the at least one spray nozzle comprises:

an upper spray nozzle that is disposed vertically between the upper rack and the second rack and configured to spray washing water upwards; and a lower spray nozzle that is disposed vertically below the lower rack and configured to spray washing water upwards.

18. The dishwasher of claim 17, wherein the at least one steam nozzle is disposed vertically above the lower spray nozzle.

19. The dishwasher of claim 1, wherein the support frame comprises at least one protrusion having a columnar shape that is connected to the lower surface of the second rack and that extends upward from the lower surface of the second rack.

20. The dishwasher of claim 19, wherein the at least one protrusion is configured to insert into an inner space of the second washing target.

* * * * *